US005577349A

United States Patent [19]

Rissone

[11] Patent Number: 5,577,349

[45] Date of Patent: Nov. 26, 1996

[54] APPARATUS FOR FORMING SEALING AROUND A DOOR

[76] Inventor: Robert D. Rissone, 134 Norcrest Dr., Rochester, N.Y. 14617

[21] Appl. No.: 258,528

[22] Filed: Jun. 10, 1994

[51] Int. Cl.[6] ..... E06B 7/16

[52] U.S. Cl. ..... 49/495.1; 49/306

[58] Field of Search ..... 49/475.1, 495.1, 49/306, 307, 308, 309, 303

[56] References Cited

U.S. PATENT DOCUMENTS

| | | | |
|---|---|---|---|
| 1,883,609 | 10/1932 | Dennis . | |
| 2,188,815 | 1/1940 | Murphy | 49/495.1 X |
| 2,739,358 | 3/1956 | Kunkel . | |
| 2,949,651 | 8/1960 | Hill . | |
| 3,171,166 | 3/1965 | Heimann et al. . | |
| 3,177,533 | 4/1965 | Davis . | |
| 3,217,921 | 11/1965 | Frehse . | |
| 3,327,429 | 6/1967 | Slaughter | 49/495.1 |
| 3,555,734 | 1/1971 | Hirtle et al. . | |
| 3,642,164 | 2/1972 | O'Neal et al. | 49/495.1 X |
| 3,704,547 | 12/1972 | Hansen et al. | 49/308 |
| 4,112,623 | 9/1978 | McPherson . | |
| 4,185,417 | 1/1980 | McKann . | |
| 4,242,392 | 12/1980 | Yackiw . | |
| 4,288,482 | 9/1981 | Beck . | |
| 4,313,990 | 2/1982 | Franklin . | |
| 4,419,315 | 12/1983 | Kessler . | |
| 4,528,775 | 7/1985 | Einarsson | 49/306 |
| 4,614,060 | 9/1986 | Dumenil et al. | 49/303 |
| 4,742,646 | 5/1988 | Kehrli . | |

FOREIGN PATENT DOCUMENTS

| | | | |
|---|---|---|---|
| 225115 | 8/1957 | Australia | 49/308 |
| 258422 | 3/1965 | Australia | 49/495.1 |
| 573864 | 4/1959 | Canada | 49/495.1 |

OTHER PUBLICATIONS

Dual Durometer Extrusions by Schlegel.

*Primary Examiner*—Jerry Redman
*Attorney, Agent, or Firm*—Myers, Liniak & Berenato

[57] ABSTRACT

A sealing system for sealing the periphery of a door relative to a frame. The sealing system includes a multi point finger seal having at least three fingers of differing height and spacing so that a first finger may contact the door and contact of the first finger and s second finger is precluded. A second finger is sized and spaced from a third finger so that a free edge of the second finger abuts the base of the third finger. A security seal is located at the bottom of the door and includes a security flap biased into the door, wherein a cam on the frame engages the flap upon closure of the door to urge the security flap toward the floor.

8 Claims, 10 Drawing Sheets

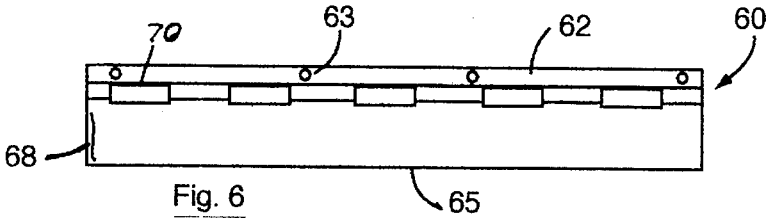
Fig. 6
Fig. 7
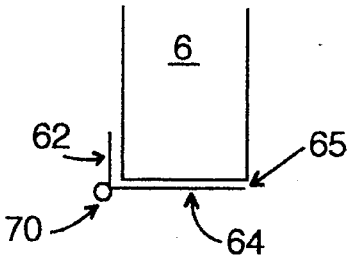
Fig. 8
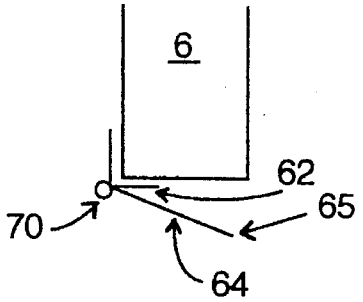
Fig. 9
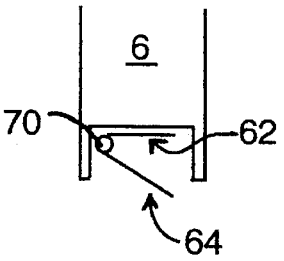
Fig. 10
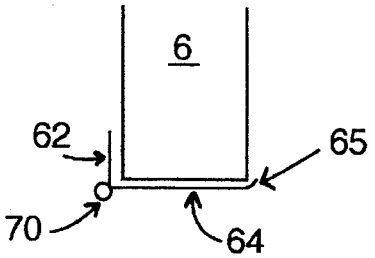
Fig. 11
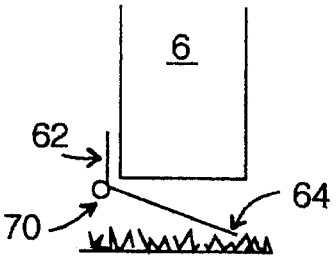
Fig. 12
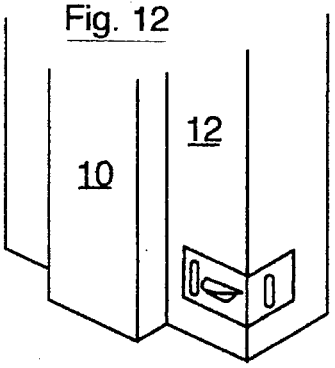
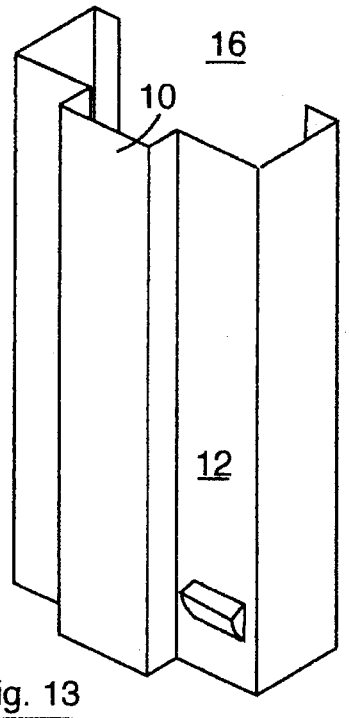
Fig. 13

FIG. 18

| Frequency | 31.5 | 63 | 125 | 250 | 500 | 1000 | 2000 | 4000 | 8000 | 16000 |
|---|---|---|---|---|---|---|---|---|---|---|
| Amplitude | | | | | | | | | | |
| closing | 47 | 45 | 45 | 43 | 47 | 51 | 52 | 52 | 52 | 51 |
| normalized | 1.09 | 1.05 | 1.05 | 1.00 | 1.09 | 1.19 | 1.21 | 1.21 | 1.21 | 1.19 |
| opening | 30 | 30 | 30 | 43 | 47 | 51 | 52 | 53 | 51 | 50 |
| normalized | 1.00 | 1.00 | 1.00 | 1.43 | 1.57 | 1.70 | 1.73 | 1.77 | 1.70 | 1.67 |
| | | | | | | | | | | |
| | | | | | | | | | | |
| closing | 45 | 45 | 45 | 45 | 47 | 49 | 51 | 52 | 57 | |
| normalized | 1.00 | 1.00 | 1.00 | 1.00 | 1.04 | 1.09 | 1.13 | 1.16 | 1.27 | |
| opening | 47 | 45 | 45 | 43 | 47 | 51 | 52 | 53 | 52 | |
| normalized | 1.09 | 1.05 | 1.05 | 1.00 | 1.09 | 1.19 | 1.21 | 1.23 | 1.21 | |
| | | | | | | | | | | |
| | | | | | | | | | | |
| closing | 43 | 45 | 45 | 47 | 47 | 50 | 52 | 52 | 52 | |
| normalized | 1.00 | 1.05 | 1.05 | 1.09 | 1.09 | 1.16 | 1.21 | 1.21 | 1.21 | |
| opening | 45 | 43 | 45 | 47 | 47 | 50 | 51 | 51 | 50 | |
| normalized | 1.05 | 1.00 | 1.05 | 1.09 | 1.09 | 1.16 | 1.19 | 1.19 | 1.16 | |

FIG. 19
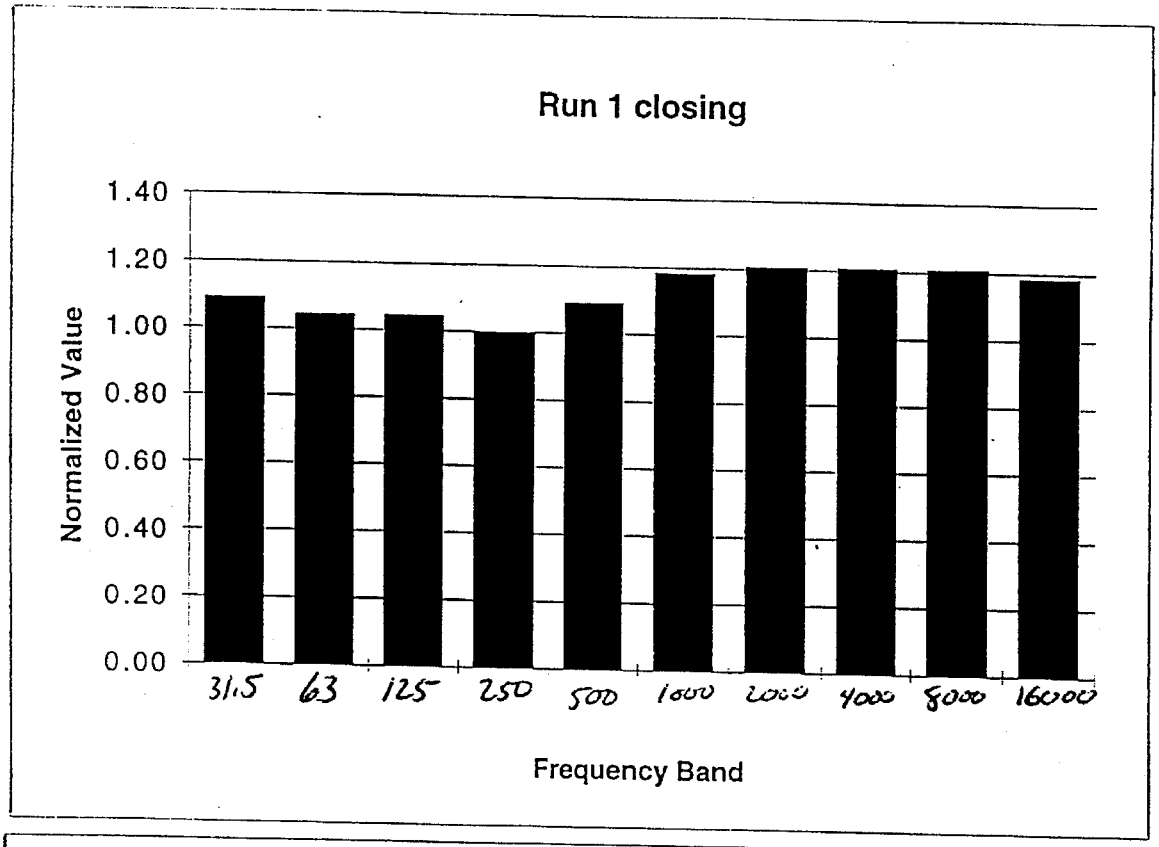
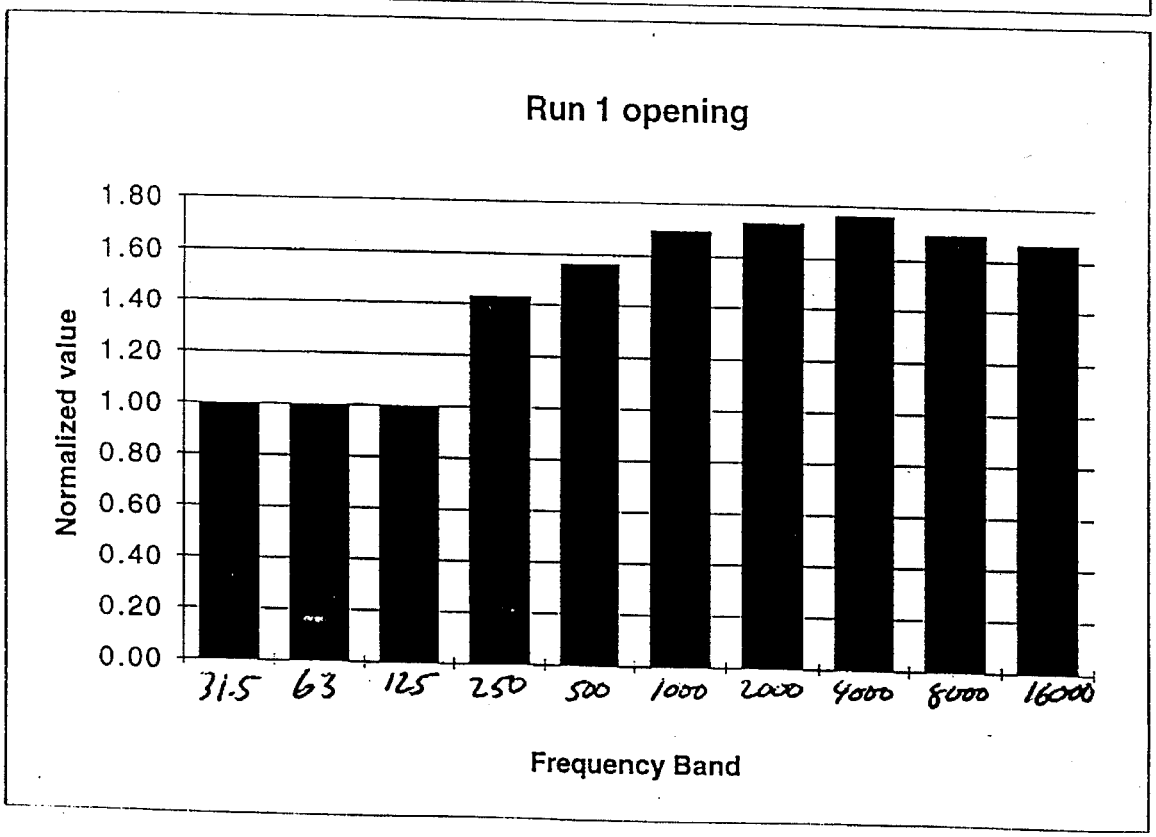
FIG. 20

FIG. 21
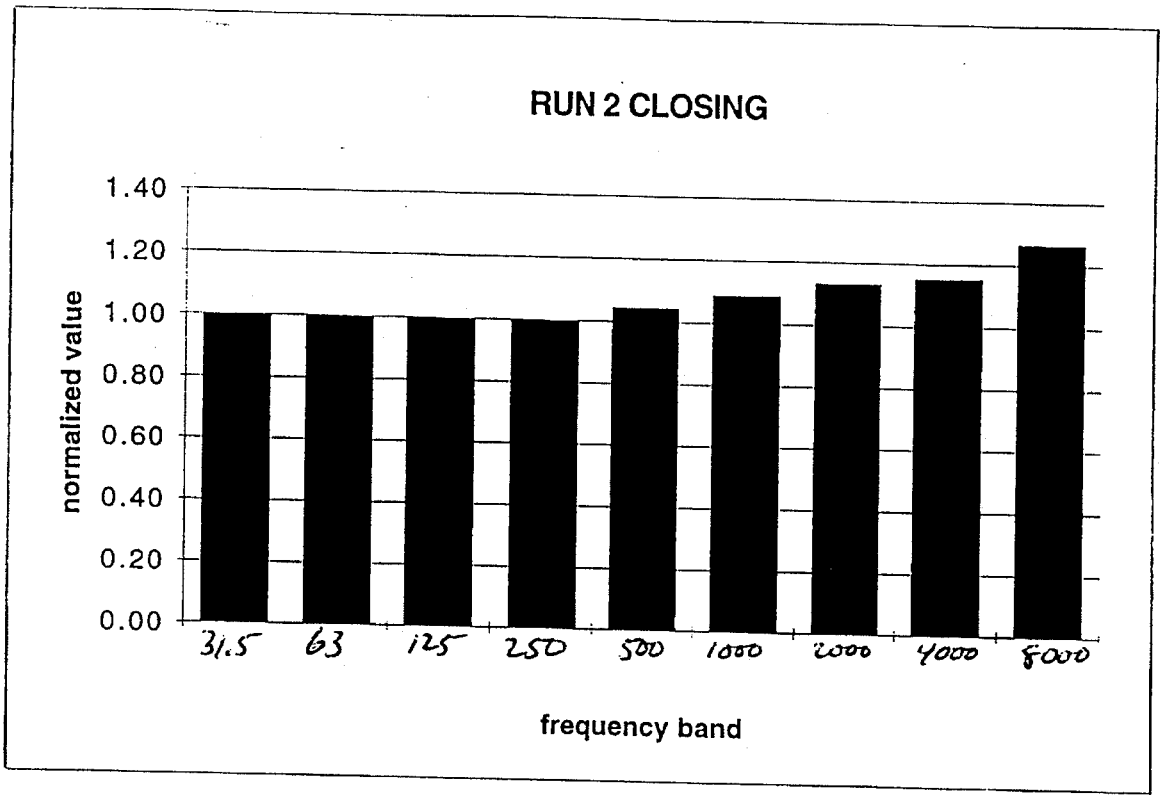
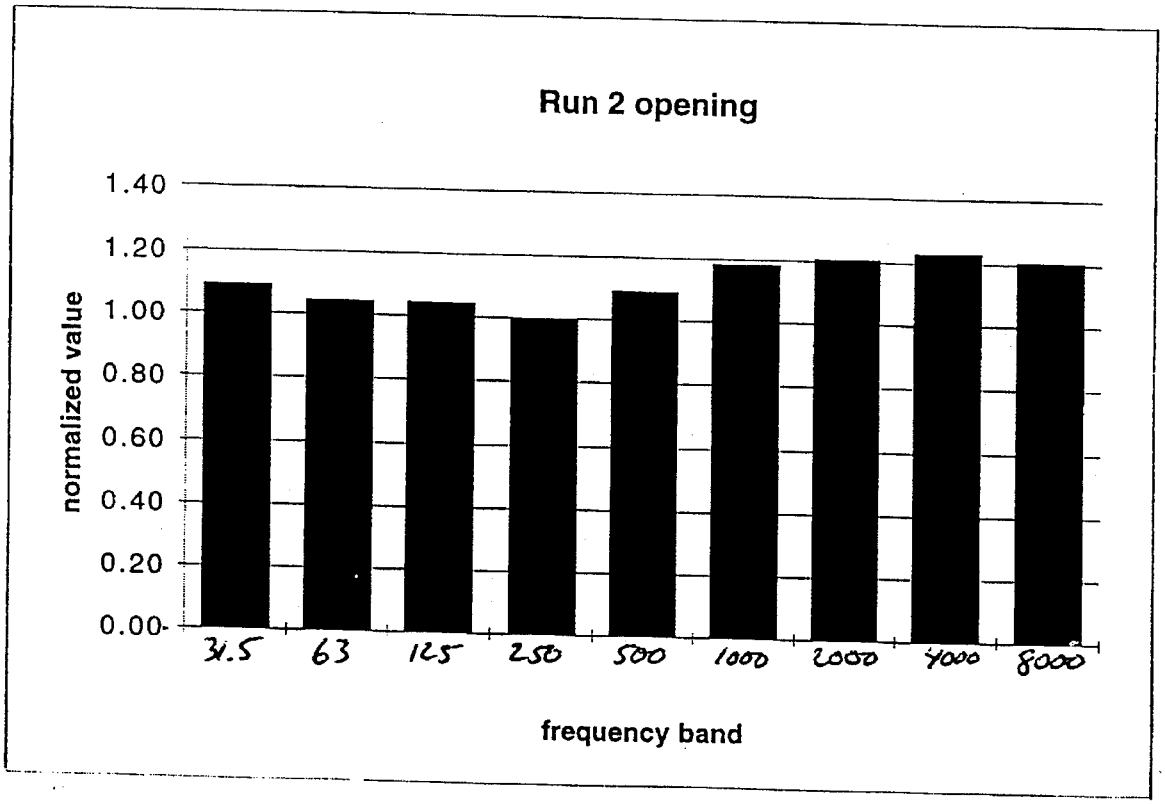
FIG. 22

FIG. 23
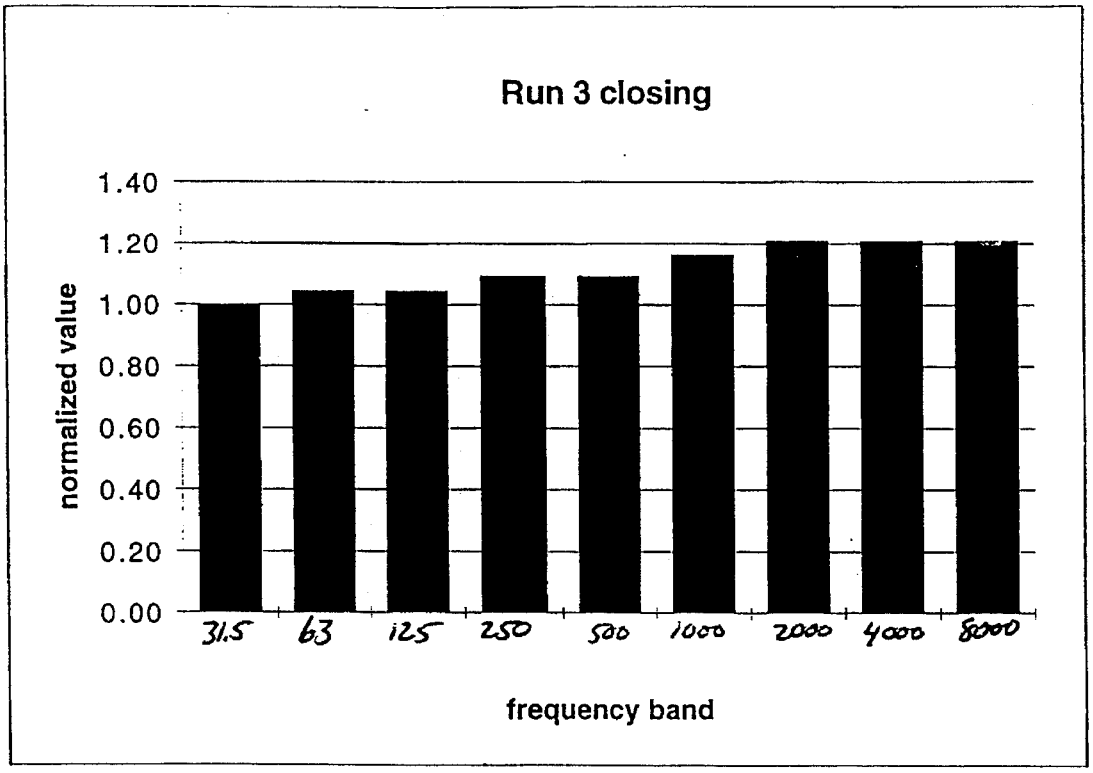
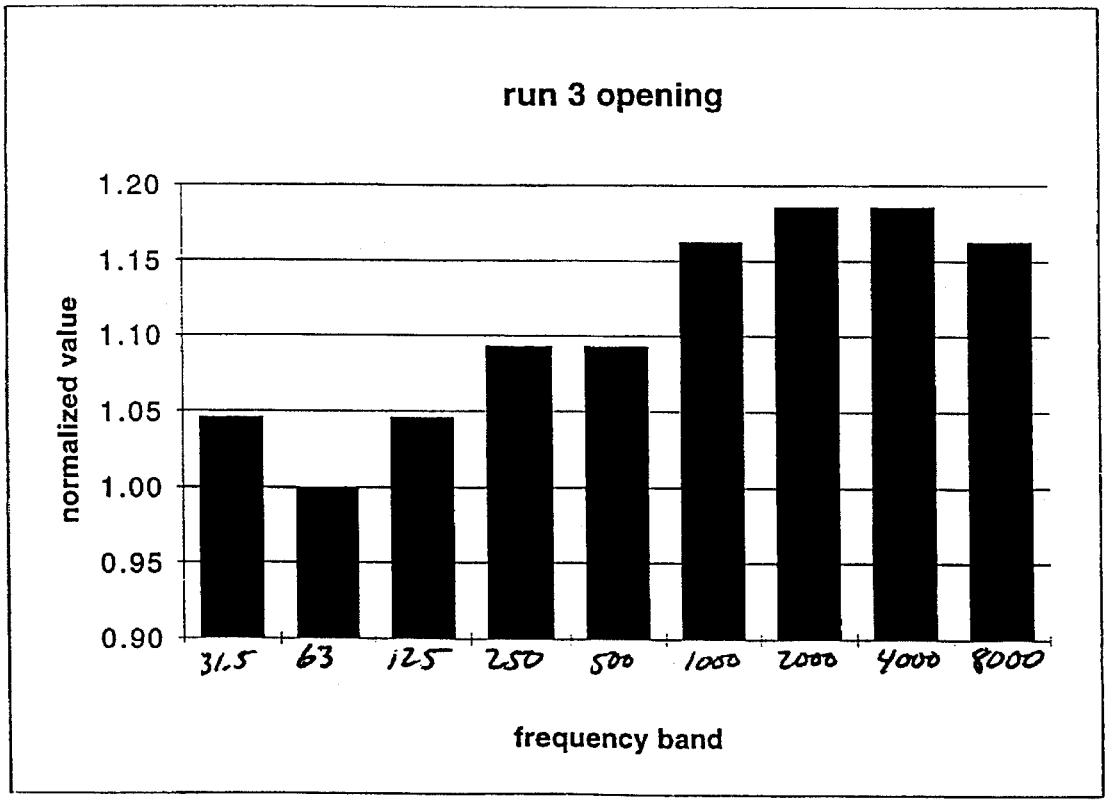
FIG. 24

APPARATUS FOR FORMING SEALING AROUND A DOOR

The present invention relates to sealing systems, more particularly, to a method and apparatus for sealing a door relative to an adjacent frame with a multi-finger seal and a rigid mechanical security seal.

BACKGROUND OF THE INVENTION

The sealing of doors to separate the inside from the outside, or a secure area from a public area is an interface which must accommodate a wide variety of demands. That is, the interface must provide sufficient security as well as permit access to individuals including handicapped. For example, as door levers are being mandated by current building codes, the use of door knobs has significantly decreased. The door handle includes a lever on both sides of the door. The latch mechanism is released by turning the handle with a force which is not to exceed a predetermined limit. Many building codes also require deadbolts for securing the door. However, the codes usually require the latch and deadbolts to be retracted simultaneously upon the single actuation of the inside handle for emergency egress. Therefore, unintended entry may be gained by bending a stiff wire, sliding it under the door and angling it back to the face of the door to loop on the lever and pulling the lever down. As the deadbolt is automatically released when the inside lever is actuated, this actuation of the inside lever substantially reduces the security provided by the deadbolt. Door guards and door chains do not add security when a person leaves a room, as these devices may be only actuated by someone inside the room. Further, once the inside handle and deadbolt are released, the remaining security devices may not provide the most sufficient security.

Further, the National Life Safety Code, State Codes, Model Building Codes, require that openings such as room entries in dormitories, hotel and motel rooms and offices from corridors must be sealed to prevent the passage of toxic gas and/or smoke and may also include a fire resistive rating. Codes also reference "Listed Authorities" for clarification of Nationally Recognized Standards such as NFPA (National Fire Protection Association) NFPA 105 for setting limits of smoke infiltration. Even if the door frame is sufficiently sealed, a sufficiently large gap at the bottom of the door may substantially defeat a frame seal. Further, many of these doors must be self closing and self latching. However, anything which rides on or rubs against a rug or floor may interfere with the self closing and latching, thereby violating the codes. While thresholds are used to seal the gap with the bottom of the door, the thresholds often present a trip hazard and may be so high as to violate handicap codes. Further, the presence of gaps between door and floor or even frame, allow penetration of noise, smoke, odor, light, and contribute to noise penetration.

Therefore, a need exists for a sealing system for precluding smoke penetration, and providing an increased measure of security. The need also exists for a sealing system that operates within predetermined force levels. A further needs exists for a seal which provides an audible confirmation of the existence of a seal between the door and the frame.

SUMMARY

A sealing system having a multi-finger seal and mechanical security seal is disclosed. The multi-finger seal includes a base which is attached to the door frame. In a preferred embodiment, four spaced apart fins project orthogonally from the base in a parallel orientation. The first finger projects from the base and defines a free edge at a first height, the second finger projects from the base and is spaced apart from the first finger by a distance greater than the first height, the second finger defines a free edge at a second height; the third finger projects from the base and is spaced apart from the second finger by a distance substantially equal to the second height, the third finger defines a free edge at a third height; and the fourth finger projects from the base and is spaced from the third finger by a distance less than the third height.

The multi-finger seal strip is normally located on the frame so that upon movement of the door between an open position and closed position, the leading edge of the door first engages the first (smallest) finger. During closure of the door, the first finger is bent over in the direction of the door movement and forms a seal between a portion of the height of the first finger and the door. The bent first finger does not contact the second finger. As the door continues closing, the door contacts the second finger and causes the second finger to be disposed toward the third finger during contact with the door. The second finger is sized so that the top of the second finger abuts the base of the third finger. As the door continues closing, the third finger is contacted by the door and is displaced so that the third finger contacts the fourth finger intermediate of the base and the free edge of the fourth finger.

The security seal substantially seals the space between the door and the support surface on the floor. The security seal includes a door engaging portion for attaching to the door; a security flap rotatably connected to the door engaging portion and a bias member for urging the security flap towards the door. The sealing flap includes a cam following surface at one end. A cam or Security Wedge Activator is attached to the frame for engaging the cam following surface and urging the flap away from the door to contact the support surface as the door is closed. In a preferred embodiment, the sealing flap is located along the bottom of the door to form a seal between the bottom of the door and the floor.

BRIEF DESCRIPTION OF THE DRAWINGS

FIG. 6 is an elevational view of a security seal;

FIG. 7 is an elevational cross sectional view showing the security seal on the bottom of a door in the open position;

FIG. 8 is an elevational cross sectional view showing the security seal affixed at alternate location and in the door closed position FIG. 9 is an elevational cross sectional view showing the security seal in a door in a closed position and affixed within a bottom recess;

FIG. 10 is an elevational cross sectional view of a security seal with a lipped free edge in the door open position;

FIG. 11 is an elevational cross sectional view of a security seal contacting a or flooring surface in door closed position;

FIG. 12 is a partial perspective view showing a cam and a cam bracket on the frame;

FIG. 13 is a partial perspective view showing a cam on a frame;

FIG. 18 is a table of performance data for the audible signal created by the present seal during opening and closing of a door;

FIG. 19 is a graph of the normalized amplitude in selected frequencies for the closing of a door against the present seal in a first run;

FIG. 20 is a graph of the normalized amplitude in selected frequencies for the opening of a door against the present seal in a first run;

FIG. 21 is a graph of the normalized amplitude in selected frequencies for the closing of a door against the present seal in a second run;

FIG. 22 is a graph of the normalized amplitude in selected frequencies for the opening of a door against the present seal in a second run;

FIG. 23 is a graph of the normalized amplitude in selected frequencies for the closing of a door against the present seal in a third run; and FIG. 24 is a graph of the normalized amplitude in selected frequencies for the opening of a door against the present seal in a third run.

DETAILED DESCRIPTION OF THE PREFERRED EMBODIMENTS

Figure 1:
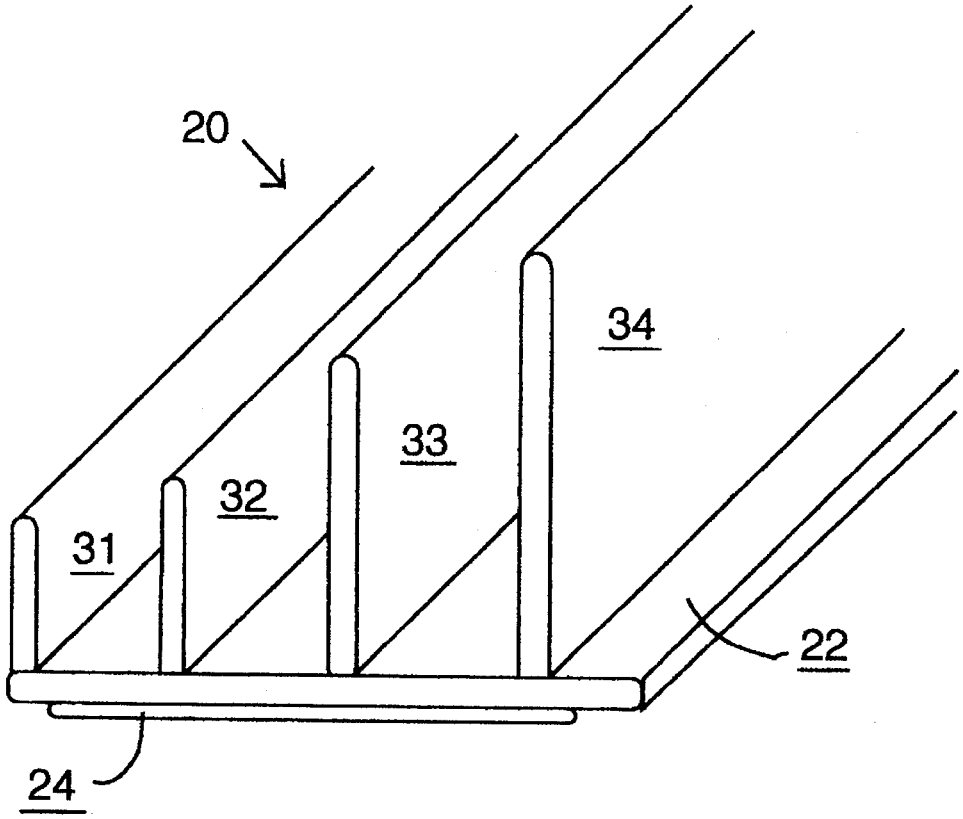
FIG. 1 is a perspective view of a length of the four finger seal.
Figure 2:
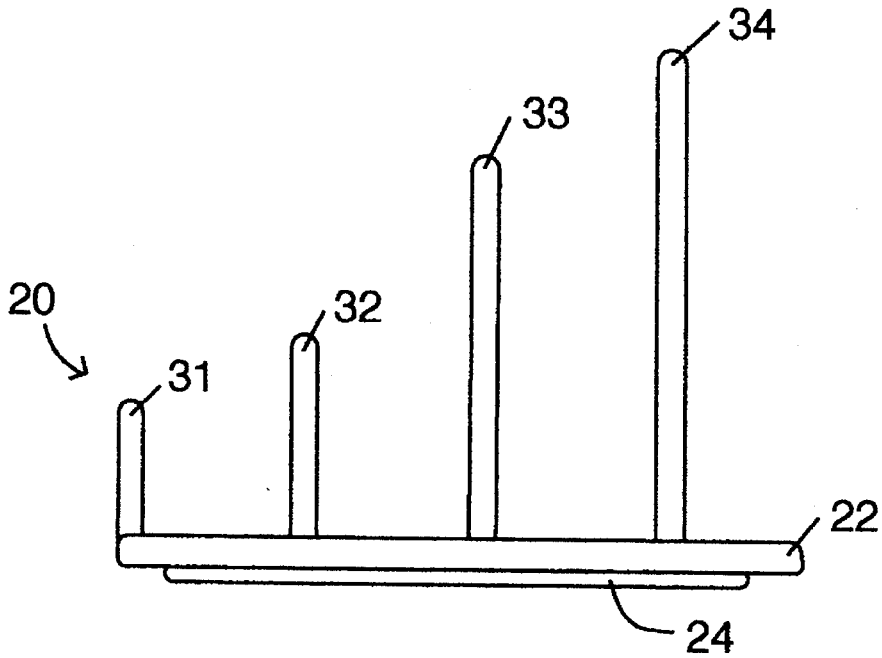
FIG. 2 is a cross sectional view of the four finger seal.
Figure 2A:
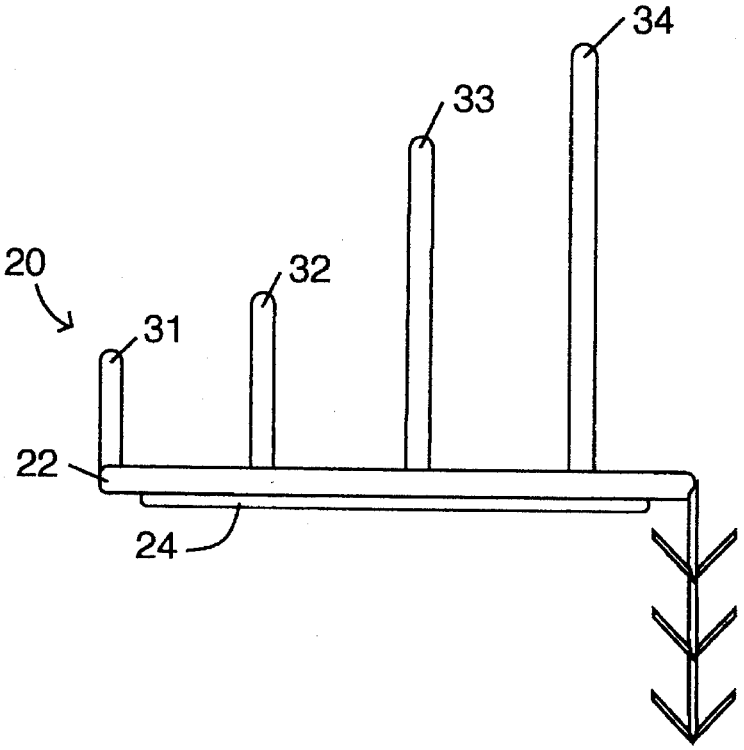
FIG. 2*a* is a cross sectional view of the four finger seal with a kerf engaging tab, for mounting on the lock jamb.
Figure 2B:
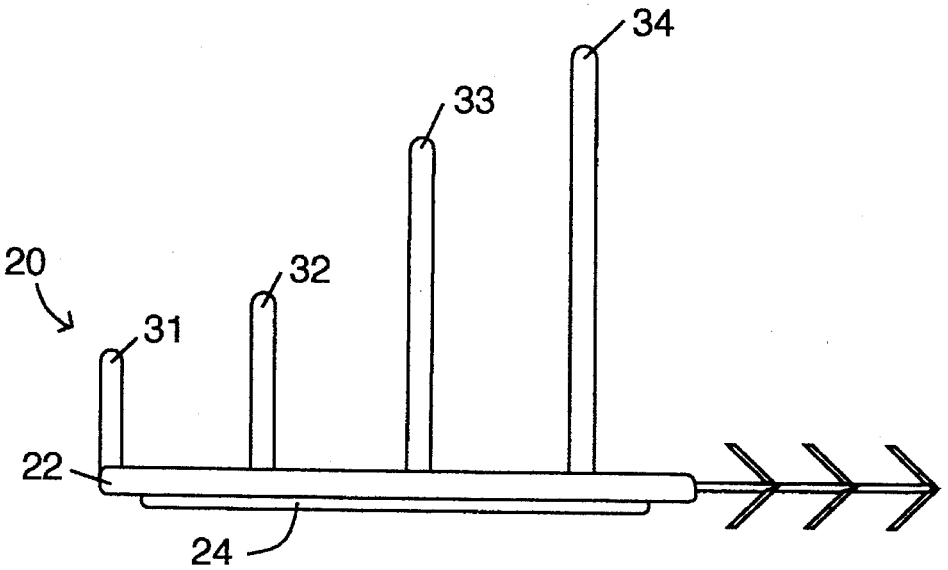
FIG. 2*b* is a cross sectional view of the four finger seal with a kerf engaging tab, for mounting on the hinge jamb.

The present description is directed to a sealing system which employs a combined multi contact point frame seal, and bottom seal. Although the invention is described in terms of a door employing both the frame seal of a multi-finger construction, and the bottom seal of a security seal construction, it is understood that the positions of the frame and bottom seals may be displaced so that the bottom seal is employed at locations other than the bottom of the door. Further, it is understood that the system may be employed with any closure system, where a closure moves between a closed position and an open position with respect to a frame.

The multi-finger seal 20 includes a substantially planar elongate base 22 having a predetermined width and a length sufficient to extend the height or width of the door. The elongate base 22 may include a pressure sensitive tape or adhesive 24 on one side for affixing the base to a door frame 6. A plurality of fingers project from the opposing side of the base 22. In each embodiment of the multi-finger seal 20 each finger projects from the base 22 to terminate at a free edge, thereby defining a height of the corresponding finger. As shown in FIGS. 1–2 and 4–5 in a preferred embodiment, four fingers project from the base 22 and are spaced apart by a predetermined distance. Generally, the fingers are oriented and sized such that a first finger 31 is the first to contact the door 6 and it moves from an open to a closed position, a second finger 32 is the second to contact the door, a third finger 33 is the third to contact the door and a fourth finger 34 is the last to contact the door. In addition, the first finger 31 projects a shorter distance than the second finger 32 which in turn projects a shorter distance than a third finger 33 which in turn projects a shorter distance than the fourth finger. The first finger 31 is substantially adjacent the edge of the base, and the last or fourth finger 34 is offset by approximately 1/16 inch from the edge of the base 20.

The distance between the first finger 31 and the second finger 32 is such that upon a bending or compression of the first finger to an orientation substantially parallel to the base 22, the first finger does not contact any portion of the second finger. The second 32 and third fingers 33 are spaced such that upon a bending of the second finger to an orientation substantially parallel with the base 22, the free edge of the second finger just abuts the base of the third finger. That is, the portion of the second finger intermediate of the base 22 and the free edge, does not contact the third finger intermediate of the base and the third finger free edge. The third finger 33 and the fourth finger 34 are sized and spaced so that the distance between the third and fourth finger is approximately 1/3 the height of the third finger. However, the range may be approximately 10 percent to 90 percent of the height of the third finger 33. Preferably, the fingers 31–34 are formed of a material having sufficient elasticity, hardness and lubricity to require less than a 5 pound force to open the door.

The multi-finger seal 20 includes the elongate base 22 of generally uniform cross section throughout its length. The finger 31, 32, 33 and 34 are affixed to one side of the base 22 and extend longitudinally along and transversely extending from the base.

The fingers 31, 32, 33 and 34 are formed as either substantially planar members, or may be formed to include undulations having a period of approximately 0.125 inches to 3.0 inches. The amplitude of the undulations is less than the distance to the nearest adjacent finger.

The pressure sensitive, or double sided adhesive tape 24 is affixed to one side of the base 22. A suitable adhesive 24 is 3M 950 transfer tape having a width of 7/16 inches. The edge of the adhesive 24 is preferably recessed from the edges of the base 22 by approximately 1/8 inch to prevent the adhesive from creeping past the periphery of the base. Although an adhesive 24 is disclosed for operably locating the multi point seal 20 relative to the frame 6, fasteners such as nails, screws or rivets may be used. That is, the fastener passes through the base 22 to partially embed in the frame. Kerf engaging tabs may be used for retaining the seal 20, as shown in FIGS. 3*a* and 3*b*.

In a specific embodiment, the base 22 has a width of approximately 0.520 inches and a thickness of approximately 0.030 inches and is formed of polypropylene. The first finger 31 is perpendicular to the base and is adjacent one edge of the base. The first finger 31 terminates at a free edge defining a height of approximately 0.095 inches from the base 22. The second finger 32 is spaced approximately 0.119 inches from the first finger 31 and defines a free edge defining a height of approximately 0.157 inches from the base 22. The third finger 33 is spaced approximately 0.119 inches from the second finger 32 and defines a free edge defining a height of approximately 0.37 inches from the base 22. The fourth finger 34 is spaced approximately 0.119 inches from the third finger 33 and extends to a free edge defining height of approximately 0.42 inches from the base 22. Preferably, the fourth finger 34 is offset by approximately 1/16 inch from the remaining side of the base 22. Each finger is approximately 0.20 inches thick. The base 22 and fingers 31, 32, 33 and 34 are formed of a material such as SANTOPRENE. (a registered trademark of the Monsanto Company) Specifically, brown SANTOPRENE having a durometer value of 55 is preferred. It is believed the durometer value must be less than 55 for the multi-finger seal 20 to function so as to not inhibit the opening of the door. In addition, the fingers may include a slipping agent such as Witco E 221 Kemamide included at approximately 1 to 2 parts per hundred to the SANTOPRENE to enhance the lubricity of the fingers.

Figure 3:
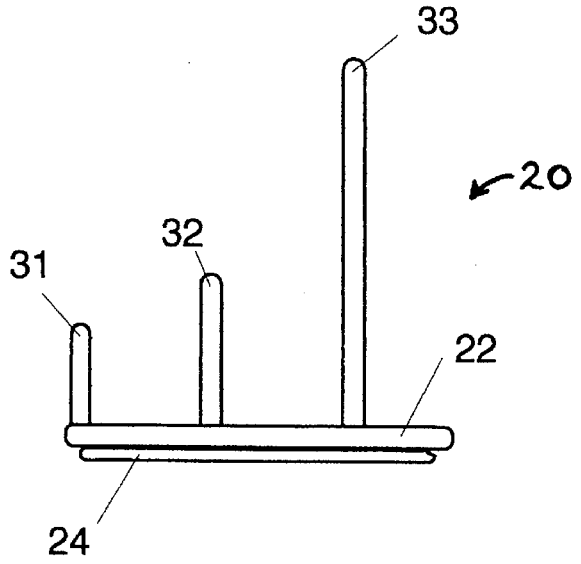
FIG. 3 is a cross sectional view of the three finger seal.
Figure 3A:
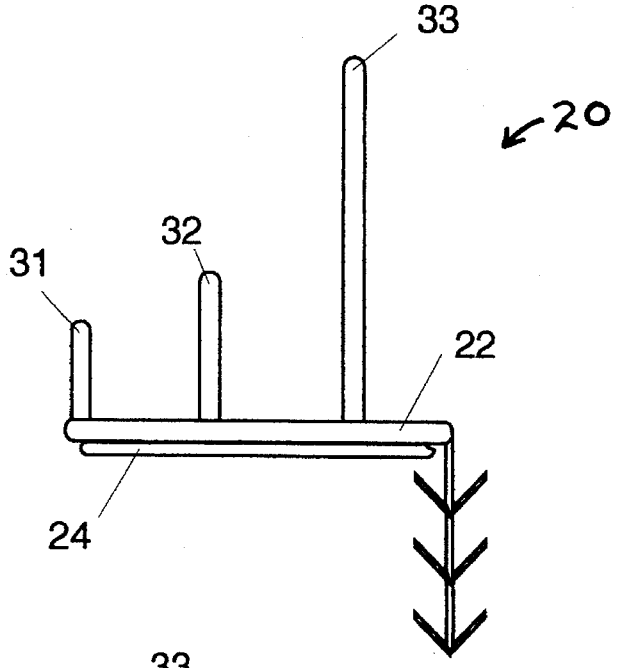
FIG. 3*a* is a cross sectional view of the three finger seal with a kerf engaging tab for mounting on the lock jamb.
Figure 3B:
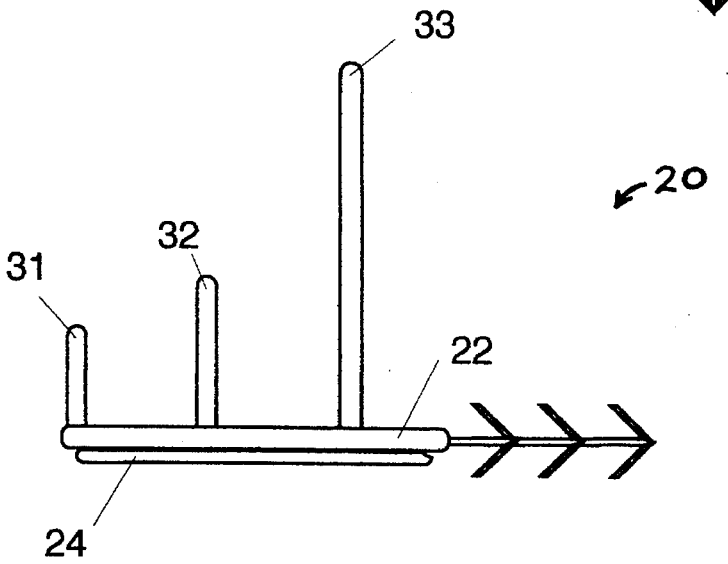
FIG. 3*b* is a cross sectional view of the three finger seal with a kerf engaging tab for mounting on the hinge jamb.

In an alternative embodiment, as shown in FIG. 3, the multi-finger seal 20 may include three fingers. The three finger seal is substantially similar to the four finger seal, wherein the differences include the lack of the fourth finger and a corresponding reduction in the width of the base 22 to approximately 0.40 inches. The first, second and third fingers 31, 32 and 33 remain as sized and spaced in the four finger embodiment.

SECURITY SEAL

Although the security seal 60 is described as cooperating with the bottom of the door 6, it is understood that the security seal may be used along the periphery of any closure member movable between an open and a closed position with respect to a frame.

As shown in FIG. 6, the security seal 60 includes a door engaging portion 62 for engaging the door 6. Preferably, the door engaging portion 62 extends substantially the width of the door 6 and has approximately 0.5 inches of contact height as shown in FIGS. 7–12. The door engaging portion 62 includes a plurality of apertures 63 through which fasteners may pass. The apertures 63 may be slightly elongated to permit adjustment. The door engaging portion 62 is affixedly attached by means of threaded fasteners or even spot welding to metallic doors. The door engaging portion 62 is sized to engage the bottom half inch of the door so that through bolts are not necessary. That is, the fasteners embed into a strip of wood that is standard in the lower most half inch of the door.

Figure 14:
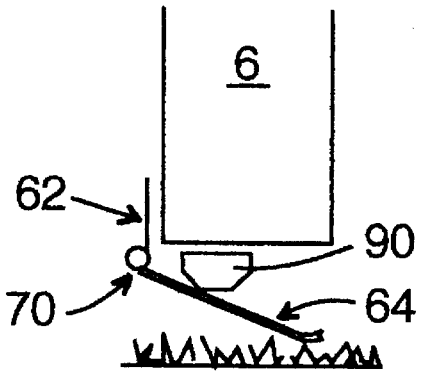
FIG. 14 is an elevational view cross sectional view showing a security seal and a cam in the door closed position.
Figure 15:
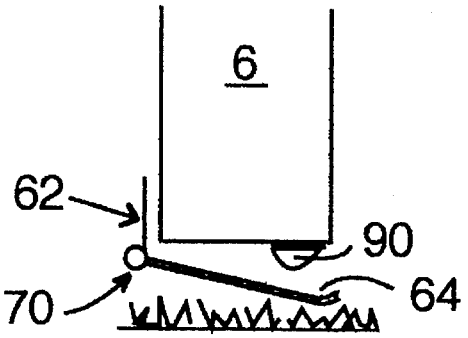
FIG. 15 is an elevational cross sectional view showing a security seal in a door closed position with the cam in an alternative position.

A security flap 64 is rotatably connected to the door engaging portion 62 and extends substantially the width of the door 6 and is movable between a first position adjacent the door and a second position spaced apart from the door. The security flap 64 terminates at a free edge 65 a distance from the rotatable connection with the door engaging portion, so that the free edge of the flap is substantially flush with the face of the door 6 in the door open position, as shown in FIG. 6. Specifically, the free edge 65 is spaced from the connection with the door engaging portion 62 such that the free edge may be rotated to a position to contact the floor. The security flap 62 may be a substantially planar member, or alternatively include a lip 66 at the free end edge 65, as shown in FIGS. 10 and 14. The lip 66 is shaped to reduce interference between the security flap 64 and the floor, as the door 6 is moved to the closed position. The security flap 64 is formed of stainless steel, extruded aluminum or plastic and has sufficient rigidity to substantially preclude torsion of the flap 64 about the connection with the door engaging portion 62. The free edge 65 may include a channel or other cross section for retaining a secondary seal which creates an interface between the security flap 64 and the floor, when the door 6 is in the closed position. Preferably, one end of the flap 64 includes a cam following surface 68. The cam following surface 68 may be formed by bending or deforming approximately a quarter inch length of the flap 64.

The rotatable connection of the security flap 64 to the door engaging portion 62 includes a hinge 70. A bias member 80 such as a spring is incorporated in the hinge 70 to urge the door engaging portion 62 and the security flap 64 to an adjacent position. The bias member includes a coil spring which may be selectively tensioned. The bias member 80 may be any of a variety of tensioning devices such as leaf springs or resilient metal. A preferred spring is an elongate coil spring or stiff wire having a plurality of coplanar and noncolinear jogs, wherein the spring may be pretensioned by rotation of one end of the spring relative to the remaining end. The tensioned spring is then pinned with respect to the door engaging portion 62 and the security flap 64. This allows the tension to be set for individual installations. The ends of the spring are chamfered to assist in installation of the spring.

Figure 16:
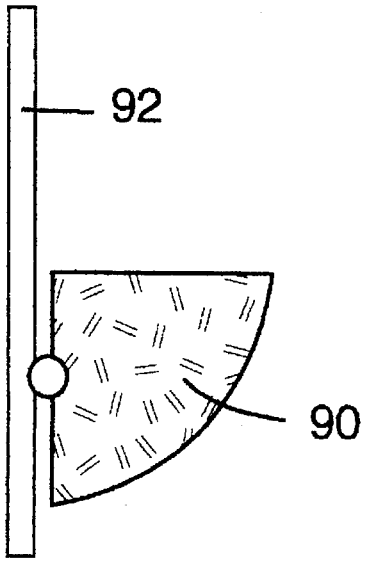
FIG. 16 is an elevational view of an alternative cam configuration.
Figure 17:
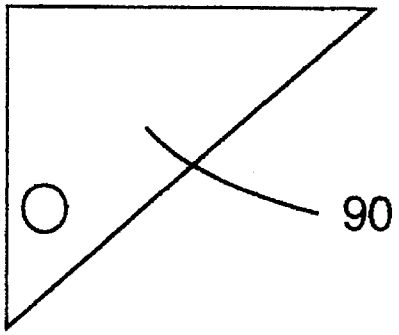
FIG. 17 is an elevational view of an alternative cam configuration.

Referring to FIGS. 12–15, a cam 90 is affixed to the door frame 8 and preferably a rabbet 12 on a hinge jamb 16 and aligned to engage the cam following surface 68 of the security flap 64 such that upon closing the door 6, the cam following surface contacts the cam and the security flap is forced downward away from the door to contact the floor. The cam 90 functions as a security wedge activation to dispose and maintain the security seal in the door closed position. Referring to FIGS. 12–13, the cam 90 is affixed to the door frame 8 by means of an adjustable bracket 92 which permits vertical and horizontal adjustment of the cam. In addition, as shown in FIGS. 16–17 the cam 90 may be formed as a arc of a sphere or circle, a spiral, french curve or even a wedge with beveled edges. The location of the cam 90 may also be adjusted by disposing the cam on a threaded lead which in turn is mounted to the bracket 92. The cam 90 is preferably mounted on a hinge jamb, but may alternatively or additionally mounted on the lock jamb. The specific curve or shape of the cam 90 and cam following surface 68 are believed to be related and at least partially dictate the location of the cam.

The cam 90 may be slidably mounted to the door adjacent the security flap to be actuated by a plunger which contacts the frame 8 as the door 6 closes. The plunger (not shown) drives the cam 90 against the cam following surface 68 to dispose the security flap 64 in the door closed position, spaced from the bottom of the door. Alternatively, the cam 90 may be pivotally attached to the door so that a portion extends beyond the periphery of the door. As the door is moved to the closed position, the overhanging portion contacts the frame thereby urging the cam against the cam following surface. When the door completely closes no portion of the cam extends substantially beyond the periphery of the door.

The present security seal is designed to mount on the hinge side (normally the secured side, private or inside of the room) of the door.

OPERATION

Figure 5:
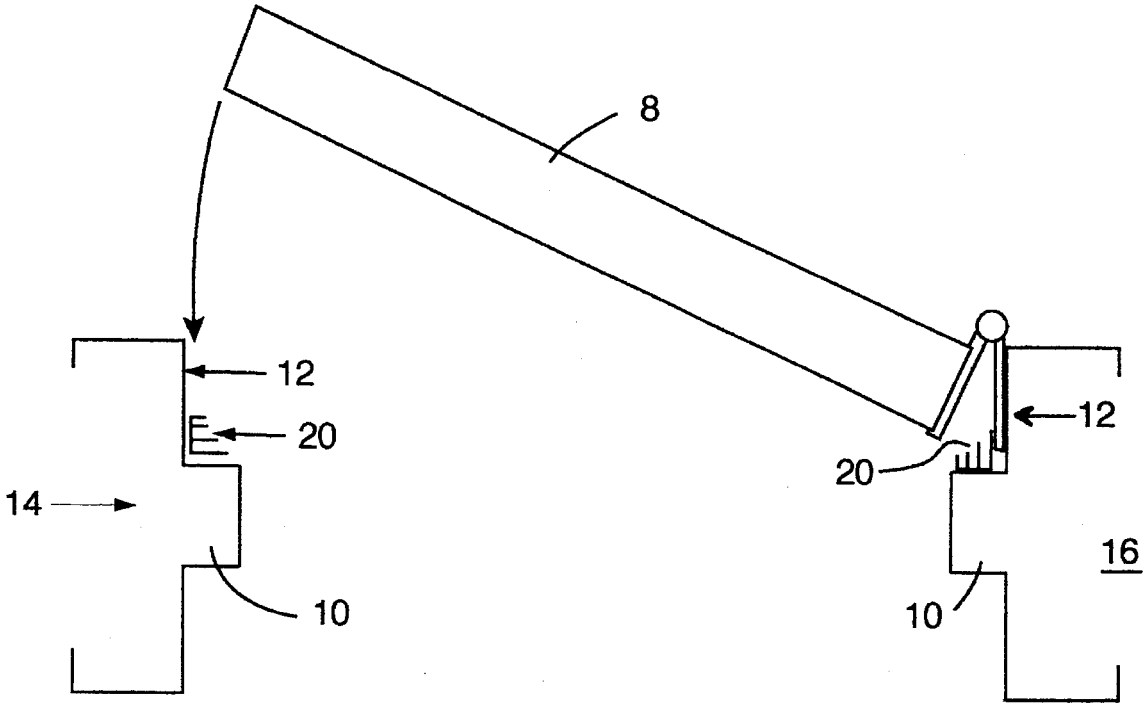
FIG. 5 is a top plan view showing the operable positioning of the multi-finger seal in a door frame.

The present invention is employed with a door 6 hingeably attached to a frame 8, wherein the frame includes a stop 10 and rabbet 12. Referring to FIG. 5, the frame 8 includes a vertical lock jamb 14 and a vertical hinge jamb 16 joined at the top by a header 18. The stop 10 extends along the jambs 14,16 and the header 18. The stop 10 is adjacent to the rabbet 12 formed in each of the jambs 14,16 and the header 18.

Figure 4:
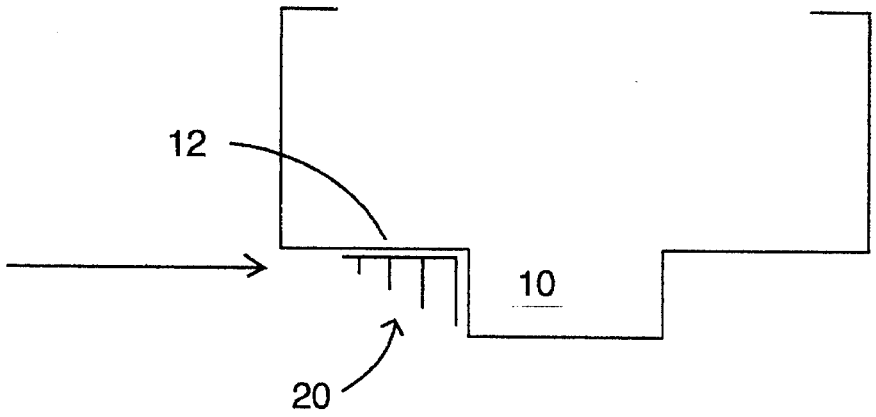
FIG. 4 is a top plan view of showing the operable orientation of the multi-finger seal with respect to the direction of closure of a door.

Generally as shown in FIGS. 4 and 5, the multi-finger seal 20 is affixed to the frame 8 so that the shortest, first finger 31 is the first finger to contact the door 6 as the door moves from the open to the closed position. The multi-finger seal 20 is disposed along the rabbet 12 in the header 18 such that the first, shortest, finger 31 is furthest from the rabbet. It is understood the multi-finger seal 20 may be attached to the hinge edge of the door 6, such that the first finger 31 initially contacts the stop 10 as the door is moved to the closed position.

The offset of the fourth, or last finger 34 from the edge of the base 22 accommodates rubber or elastomeric mutes which are often employed on the stop 10 to cushion the closing of the door 6. This allows installation of the present system without requiring removal of the mutes. Preservation of the mutes is important as the mutes may function to align doors with cylindrical locks having a dead latching pin. If the door is not aligned the dead latching pin may pass into the keeper rather than contacting the strike plate, thereby preventing the dead latching pin from operating. The offset edge of the base 22 also serves as an installation guide for aligning the seal 20 along the frame 8.

Referring to FIG. 5, on the lock jamb 14, the multi-fingered seal 20 is affixed to the rabbet 12 such that the side of the seal adjacent the fourth 34 or longest finger abuts the intersection of the stop 10 and the rabbet 12. Therefore, for the arc traced by the free vertical edge of the door 6 as the door swings closed intersects the multi-fingers so that the first finger 31 is the first contacted finger.

As shown in FIGS. 5, on the hinge jamb 16 of the frame 8, the multi-finger seal 20 is mounted to the stop 10 so that the longest finger is adjacent to intersection of the stop and the rabbet 12 and the shortest finger 31 would first contact the door 6 as it is swung shut. That is, the arc traced by the inner or hinged edge of the door 6 first intersects the first finger 31 as the door travels from the open to the closed position.

Referring to FIGS. 7–9, the security seal 60 may be attached to the door 6 at a variety of locations, as dictated by the specific door design. The door engaging portion 62 may be disposed along the inside surface of the door, along the bottom of the door or disposed within a recess in the bottom of the door.

The door engaging portion 62 is preferably attached to the inside, security side of the door 6. The door engaging portion 62 is attached at a location which is inaccessible to the outside. The door engaging portion 62 is attached so that the security flap 64 is movable from an open door position substantially parallel to and adjacent the bottom of the door 6 to a closed door position, wherein the free edge 65 of the flap contacts the floor.

The cam 90 is attached to the door frame 8 on the hinge jamb 16 and aligned so that the cam contacts the cam following surface 68 upon closing of the door 6. The location of the cam 90 is such that in the closed position of the door 6, the free edge of the flap 64 contacts the floor and the cam substantially precludes the flap from returning to the open door position.

As the door 6 is swung from the open position to the closed position, the free edge of the door and the inner hinge edge initially contact the first finger 31. The first finger 31 is bent from its perpendicular orientation to a skewed orientation and forms a seal between a portion of the height of the first finger and the door. As the first finger 31 is spaced from a second Finger 32 by a distance greater than the height of the first finger, upon contact and deformation by the door 6, the first finger does not contact the second finger. As the door continues to the closed position, the second finger 32 is contacted by the door and is disposed toward the third finger 33. The second finger is sufficiently displaced so that a portion of the height of the second finger forms a seal with a door. The free edge of the second finger 32 just abuts, but does not substantially overlap the third finger 33. That is, as the second 32 finger is displaced to an orientation substantially parallel to the base 22, the free edge of the second finger just contacts the third finger 33 adjacent the intersection of the base and the third finger.

As the door 6 continues closing, the third finger 33 is contacted by the door and a portion of the height of the third finger contacts the door and forms a seal. This completes the seal in the three finger embodiment. In the four finger embodiment, the third finger 33 deforms to contact the fourth finger 34 at approximately half the height of the fourth finger. It is believed that as the third finger 33 contacts the fourth finger 39 during door closure, air trapped between these fingers is partially compressed to absorb the noise of the door closure.

Simultaneously as the door is moved to the closed position, the cam following surface 68 contacts the cam 90 on the frame 8 and the cam urges the flap 64 against the bias member 80 so that the free edge of the flap contacts the floor.

The multi-finger seal 20 creates an audible confirmation of seal formation upon closing and opening of the door. In addition, the multi-finger seal 20 attenuates or reduces the sound of door closure. In opening the door 6 the multi-finger seal 20 generates audible confirmation throughout the period of contact between the seal and the door. With respect to the jambs 14,16, the signal is generated for the entire distance of travel as the door edge passes the seal. On the header 18, the point of separation contact between the multi-finger seal 20 and the door 6 travels from the free edge to the hinged edge, such that the travel of the point of contact generates the audible signal. It has been found the audible signal is generated throughout approximately the first 15° of travel as the door 6 moves from the closed position. The acoustic signature of the seal is shown in FIGS. 18–24. It is believed the acoustic signature is substantially created by the first and second finger 31, 32 moving from a first nonperpendicular position when the door is in the closed position to a second nonperpendicular position as the door is being opened. That is, the finger moves from being bent, tilted towards the fourth finger to bent on tilted away from the fourth finger when the door is opened.

It has been found that the opening of a door 6 against a 4 finger multi-finger seal 20 creates an acoustic signature defined by normalized amplitudes of between 1.0 and 1.7 for the frequencies 31.5; 63; 125; 250; 500; 1000; 2000; 4000; 8000; and 16000 hertz. That is, the audible confirmation upon opening a door with the multi-finger seal is defined by an amplitude in each of these frequency ranges that is with 1.7 of the lowest amplitude.

The multi-finger seal 20 and the security seal 60 also provide a resistance to opening which is less than approximately 5 pounds force acting upon the door handle. Specifically, for a single inswing interior wood door, 35.75 inches wide, 79.25 inches high and 1 ⅝ inches thick with the four finger seal the following table represents the data:

| Seal Material | Opening force lbs |
|---|---|
| Brown Santoprene 55 durometer | 3.00 |
| | 2.50 |
| | 2.50 |
| | 2.50 |
| | 2.50 |

Therefore, the present seal configuration permits seal confirmation and closure noise reduction, while providing audible confirmation upon opening and opening under five pounds force.

The present sealing system also reduce air flow past the door 6. For an interior commercial solid core door 1.75 inches thick; 36 inches wide and 80 inches high in a steel non adjustable Ceco drywall 16 gauge 4 ⅞ inch drywall frame with standard Hager 1274 (4.5×4.5) hinges, a PDQ Freedom SV 126 UL latch lock set with clearance between the bottom of door slab to floor of approximately ⅝ to ¾ inch and door slab to edge to jamb clearance of ⅛ to ⅜ inch at a pressure difference across the door of 0.1 inch water, the air flow rate past the door and frame is 0.60 cubic feet per minute. For the same conditions the air flow rate is 0.69 cfm at 0.15 pressure; 0.81 at 0.20 pressure; and 0.91 at 0.25 pressure.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

We claim:

1. A multi-finger smoke and fire seal system sealing between a door and surrounding frame, the frame including a stop and a rabbet surrounding strike and hinge sides of the door, the seal system comprising:

a first multi-finger seal portion at least a portion of which is disposed on a lock jamb adjacent the strike side of the door, said first seal portion including a base affixed upon the rabbet on the lock jamb and a plurality of flexible fingers extending therefrom, said fingers including first, second, and third fingers extending from said base, said first finger having a length less than said second and third fingers, and said third finger having a length greater than said first and second fingers, wherein said third finger is located closest to the stop on the lock jamb and said first finger is disposed farthest from the stop so that said first finger is first contacted and bent by the door toward said second finger when the door is being closed; and a second multi-finger seal portion disposed on a hinge jamb adjacent the hinge side of the door, said second seal portion including a base attached upon the stop of the hinge jamb so that the base of the second seal portion is arranged substantially perpendicular to the base of the first seal portion, said second seal portion further including first, second, and third flexible fingers extending from said second seal portion base with the first finger of the second seal portion being the shortest of the three and located farthest from the rabbet of the hinge jamb and the third finger of the second seal portion being the longest of the three and located on the stop closest to the rabbet of the hinge jamb so that the hinge side of the door first contacts and bends the first finger of the second seal portion toward the second finger of the second seal portion when the door is being closed.

2. The seal system of claim 1, wherein the first fingers of said first and second multi-finger seal portions are of a length short enough so that when they are bent toward the second fingers by the closing door they do not overlap the second finger adjacent them thereby creating small resistance to closing of the door and allowing for reduced clearance between the door and the adjacent frame.

3. The seal system of claim 1, wherein the seal system creates an acoustic signature upon opening of the door defined by a normalized profile of approximately 1.0 at approximately 31.5 hertz; approximately 1.0 at approximately 63 hertz; approximately 1.0 at approximately 125 hertz; approximately 1.43 at approximately 250 hertz; approximately 1.57 at approximately 500 hertz; approximately 1.70 at approximately 1,000 hertz; approximately 1.73 at approximately 2,000 hertz; approximately 1.77 at approximately 4,000 hertz; approximately 1.70 at approximately 8,000 hertz; and approximately 1.67 at approximately 16,000 hertz.

4. The seal system of claim 1, wherein the seal system creates an acoustic signature upon the opening of the door substantially defined by a normalized profile of approximately 1.09 at approximately 31.5 hertz; approximately 1.05 at approximately 63 hertz; approximately 1.05 at approximately 125 hertz; approximately 1.0 at approximately 250 hertz; approximately 1.09 at approximately 500 hertz; approximately 1.19 at approximately 1,000 hertz; approximately 1.21 at approximately 2,000 hertz; approximately 1.23 at approximately 4,000 hertz; and approximately 1.21 at approximately 8,000 hertz.

5. A security seal system attachment to a bottom of a door, the door having exterior and interior sides, the security seal system comprising:

a door engaging portion affixed to the interior side of the door;

a security flap pivotally connected to said door engaging portion by way of a hinge;

a cam following surface affixed to said security flap proximate an edge thereof; and a cam affixed to a door jamb adjacent the door, said cam for contacting said cam following surface when the door is being closed thereby causing said cam following surface and said security flap to move downward toward the ground so as to form a security seal under the door when the door is in a closed position.

6. The security seal system of claim 5, further including:

a biasing member for biasing said security flap upward away from the ground when the door is in an open position; and wherein said cam is affixed to the rabbet of the door jamb and forces said cam following surface and said security flap downward upon door closing.

7. The security of seal system of claim 6, wherein said cam is affixed to the rabbet by way of a base plate having first and second vertically aligned elongated apertures defined therein so that the position of said cam on the rabbet is vertically adjustable relative to said cam following surface.

8. A multi-finger smoke and fire seal for sealing between a door and surrounding frame, the multi-finger seal comprising:

a base for mounting on one of a stop and rabbet of the surrounding frame;

first, second, and third flexible sealing fingers protruding outwardly from said base, said second finger being located immediately between said first and third fingers with said first finger having the smallest length and said third finger having the greatest length, wherein said first finger is located relative to the door so that it is first contacted and bent by the door toward said second finger when the door is closing;

said first finger having a length sufficiently small so that when contacted and bent by the closing door said bent first finger does not overlap said second finger; and wherein said multi-finger smoke and fire seal, upon opening of the door, creates an acoustic signature defined by a normalized profile of approximately 1.0 to 1.09 at about 31.5 hertz; approximately 1.0 to 1.05 at about 63 hertz; and approximately 1.19 to 1.73 at about 2,000 hertz, whereby opening of the door causes the seal to create a recognizable acoustic sound.

* * * * *